US005440996A

United States Patent [19]

Cottino

[11] Patent Number: 5,440,996

[45] Date of Patent: Aug. 15, 1995

[54] TRACK SET WITH ROTATING INTERSECTION FOR TOY TRAINS

[75] Inventor: Vittorio Cottino, Castello, Italy

[73] Assignee: Mattel, Inc., El Segundo, Calif.

[21] Appl. No.: 194,770

[22] Filed: Feb. 10, 1994

[51] Int. Cl.[6] ..... B61J 1/00; E01B 7/00

[52] U.S. Cl. ..... 104/47; 104/35; 104/DIG. 1; 238/10 E; 246/415 A; 446/433; 446/447

[58] Field of Search ..... 104/35, 47, 53, 60, 104/99, 130 R, 130 H, DIG. 1; 238/10 E, 10 F; 246/415 R, 415 A; 446/433, 444, 446, 447

[56] References Cited

U.S. PATENT DOCUMENTS

| | | | |
|---|---|---|---|
| 413,593 | 10/1989 | Williams . | |
| 434,692 | 8/1990 | Williams . | |
| 1,736,487 | 11/1929 | Cooper . | |
| 1,840,914 | 1/1932 | Ottenstein . | |
| 1,885,366 | 11/1932 | Martini . | |
| 1,911,241 | 5/1933 | Rosenthal . | |
| 1,911,242 | 5/1933 | Rosenthal . | |
| 2,211,220 | 8/1940 | Verplanck | 104/35 |
| 2,514,652 | 7/1950 | Leithold | 238/10 E X |
| 2,866,418 | 12/1958 | Petrick, Sr. | 104/149 |
| 3,117,755 | 1/1964 | Kretzmer, Jr. | 246/415 R |
| 3,205,833 | 9/1965 | Fitzpatrick . | |
| 3,206,122 | 9/1965 | Frisbie et al. . | |
| 3,313,242 | 4/1967 | Voce | 104/60 |
| 3,377,958 | 6/1965 | Bax et al. | 104/60 |
| 3,564,236 | 2/1971 | Ernst . | |
| 3,589,063 | 6/1971 | Genin . | |
| 3,590,679 | 7/1971 | Law . | |
| 3,618,947 | 11/1971 | Cooper . | |
| 3,680,777 | 8/1972 | Arai . | |
| 3,775,897 | 12/1973 | Soulakis et al. . | |
| 4,148,152 | 4/1979 | Barlow et al. . | |
| 4,369,943 | 1/1983 | Hussein . | |
| 4,531,966 | 4/1985 | Mucaro et al. . | |
| 4,726,515 | 2/1988 | Bolli et al. | 238/10 E |
| 4,941,611 | 7/1990 | Arsenault | 238/10 A |
| 5,087,001 | 2/1992 | Bolli et al. | 246/327 |

FOREIGN PATENT DOCUMENTS

| | | |
|---|---|---|
| 2237640 | 7/1972 | Germany . |

*Primary Examiner*—Robert J. Oberleitner
*Assistant Examiner*—S. Joseph Morano
*Attorney, Agent, or Firm*—Roy A. Ekstrand

[57] ABSTRACT

A track set as set forth for use with a toy train or the like includes a pair of mirror image C-shaped track portions coupled to a circular base. A circular platform is rotatably supported upon the base and includes a plurality of track segments supported thereon. The track segments include orthogonally intersecting straight track portions as well as offset arcuate curved portions symmetrically arranged upon the platform. The base further defines an upwardly extending annular rim which defines a plurality of notches equally spaced thereupon. A platform lock includes a pivotable handle receivable within the notches to securely position the platform at a selected rotational position and thereby align selected track segments of the platform with the C-shaped track portions. The travel path of the track set may be configured to provide a figure-eight, a peanut-shape, and a pair of separate distinct circular travel paths.

11 Claims, 4 Drawing Sheets

TRACK SET WITH ROTATING INTERSECTION FOR TOY TRAINS

FIELD OF THE INVENTION

This invention relates generally to toy vehicle track sets and particularly to those using toy train vehicles and the like.

BACKGROUND OF THE INVENTION

Toy train sets have become popular with children of a great variety of ages and experience levels. Such train sets have included simple unpowered trains manipulated by the child user as well as gravity-powered train sets in which an elevating launching platform is coupled to an angled track portion to provide acceleration of the train set. Directly powered train sets have included those using a locomotive having a wind-up motor drive as well as electrically powered locomotives such as battery power or electric current applied to the train track. The character of such train sets has varied from fanciful cartoon-like structures to sophisticated extremely realistic train models. The track sets utilized by such train sets have enjoyed equal variety ranging from simple single loop configurations to multiply looped complex track sets with interconnecting switches to provide multiple travel paths.

In attempting to meet the needs of consumers, practitioners in the art have provided a virtually endless variety of toy train track sets. For example, U.S. Pat. No. 3,590,679 issued to Law sets forth a XYLOPHONE TYPE TOY in which a musical toy railroad includes a track composed of sound emitting bodies. The toy vehicle moving along the track strikes the sound emitting bodies and produces a musical tune.

U.S. Pat. No. 5,087,001 issued to Bolli, et al. sets forth an ACTUATING DEVICE IN A TOY TRACK ASSEMBLY in which a switch point for a toy cog railway having smooth tracks utilizes a centrally disposed gear rod comprising a shifting device with a curved and straight gear rod piece for providing driving direction. The shifting device which supports the gear rod pieces is laterally displaceable with respect to the track direction and a tonguelike actuating element is disposed within a longitudinal slot. Each actuating element is coupled to a rotating mounted disk by way of pivoted levers which in turn are coupled to the shifting device. The vehicle which travels on the switch point actuates the switch in the protruded or extending position.

German Patent 2,237,640 sets forth an ELECTRIC MODEL TRACK using a two track two conductor method in conjunction with simplified switches. The track layout may includes loops, figures of eight and asymmetric junctions. The electrical current is supplied through the track rails or overhead cables or a combination of both.

U.S. Pat. No. 4,369,943 issued to Hussein sets forth a MODEL TRAIN CROSSING GATE having a detector circuit which employs two pairs of magnetically operated relays positioned on either side of a gate crossing along a set of tracks. In addition, a single magnetically operated relay is located at the grade crossing and is oriented orthogonally to the pair of relays. The locomotive of the model railroad is equipped with a first magnet for operating the pairs of relays and at least one car has a second magnet for operating the relay at the grade crossing. The control circuit responds to the relays to operate the gate and crossing lights.

U.S. Pat. No. 4,148,152 issued to Barlow, et al. sets forth a CONSTRUCTION TOY WITH REVERSIBLE TRACK HAVING SOUND PRODUCING MEANS in which a construction toy includes a base portion having a grid defined thereon by a plurality of substantially vertical grooves for use in combination with accessory articles. The grooves defined on the grid are arranged to intersect at right angles each pair of which defines a track section.

U.S. Pat. No. 3,680,777 issued to Arai sets forth a VARIABLE TRACK FOR A TOY VEHICLE having a plurality of pliable bed sections and a pair of pliable rails. The rails are removably attached to the bed sections in parallel spaced apart relationship to form the course of travel for the toy vehicle. The track may be shaped as desired.

U.S. Pat. No. 3,589,063 issued to Genin sets forth a MOTORIZED SHUTTLE TRAIN having a track layout which includes a turntable adapted to link any one of a group of sidings to a steep track section leading to the top of an elevator tower.

U.S. Pat. No. 3,564,236 issued to Ernst sets forth a SWITCH, ESPECIALLY DOUBLE CROSS SWITCH FOR ELECTRIC TOY AND MODEL RAILROAD INSTALLATIONS for use in model railroads having conductive tracks carrying operating current for the locomotive. Conductive plates are provided which extend closely to the central portion of the switch and which within the switch form electrical current conductive surfaces for contact with the wheel rims of rail vehicles passing over the switch.

U.S. Pat. No. 1,911,242 issued to Rosenthal sets forth a MOUNT FOR TOY RAILWAY UNITS having a planar support bed and wheeled structure supporting the bed for receiving and supporting a railway track. A similar structure is shown in U.S. Pat. No. 1,911,241 also issued to Rosenthal.

U.S. Pat. No. 1,885,366 issued to Martini sets forth a RAILROAD TRACK SWITCH in which a pair of track sidings are coupled to a pivotally supported rail switch along each rail. The switch is pivotable between alternate positions to switch an oncoming train to alternate track sidings.

U.S. Pat. No. 1,840,914 issued to Ottenstein sets forth a TRACK FOR TOY VEHICLES having linearly arranged intersecting track segments.

U.S. Pat. No. 1,736,487 issued to Cooper sets forth a TOY RAILROAD TRACK having an intersecting switch defining a general X-shape operative between parallel sidings. The X-shaped track intersection includes movable switch elements which transfer a train vehicle between track segments.

U.S. Pat. No. 434,692 issued to Williams sets forth a STREET RAILWAY SWITCH for use on intersecting track segments includes a pivotally supported circular track switch having alternate paths defined therein which is rotatable between first and second positions to switch a train vehicle.

U.S. Pat. No. 413,593 also issued to Williams shows a similar structure.

In a related art, toy vehicle race tracks have shown similar track-like structures. For example, U.S. Pat. No. 4,941,611 issued to Arsenault sets forth a TOY ROADWAY TILE in which a plurality of tiles having track or roadway portions defined therein are interlockably coupled to form track patterns.

U.S. Pat. No. 4,726,515 issued to Bolli, et al. sets forth a TRACK SYSTEM FOR TOY VEHICLES while U.S. Pat. No. 4,513,966 issued to Mucaro, et al. sets forth a VEHICLE JUMP FOR A TOY VEHICLE GAME. U.S. Pat. No. 3,775,897 issued to Soulakis, sets forth an INTERSECTION DEFLECTOR FOR TOY VEHICLE TRACKS while U.S. Pat. No. 3,618,947 issued to Cooper sets forth an START FINISH MECHANISM FOR RACING GAME.

U.S. Pat. Nos. 3,377,958 issued to Bax, et al.; 3,313,242 issued to Voce; 3,206,122 issued to Frisbie, et al.; 3,205,833 issued to Fitzpatrick; 3,117,755 issued to Kretzmer, Jr.; and 2,866,418 issued to Petrick, Sr. set forth a variety of toy vehicle raceways or roadbeds having multiple track portions and transition elements between the track portions.

While the foregoing described prior art devices have enjoyed certain levels of success and consumer acceptance, there remains nonetheless a continuing need in the art for evermore improved track sets for use with toy trains and the like.

SUMMARY OF THE INVENTION

Accordingly, it is a general object of the present invention to provide an improved track set for use with toy trains and the like. It is a more particular object of the present invention to provide an improved track set for use with toy trains and the like which provides a simple, easy to use, rotating track intersection easily operable by younger children.

In accordance with the present invention, there is provided a toy vehicle track set comprises: a base; a track intersection having a platform rotatably supported by the base and having a pair of intersecting generally straight track segments and a pair of curved track segments each intersecting a common one of the straight track segments on opposite sides of the intersection of the straight track segments; a pair of loop track segments supported on each side of the track intersection each having open ends; and lock means for securing the platform at a plurality of rotational positions, the platform being rotatable to a first position in which the straight track segments couple the loop track segments to form a figure-eight path, a second position in which the pair of curved segments couple the loop track segments to form a peanut-shaped path and a third position in which the pair of curved track segments couple the loop track segments to form two separate closed loop paths.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
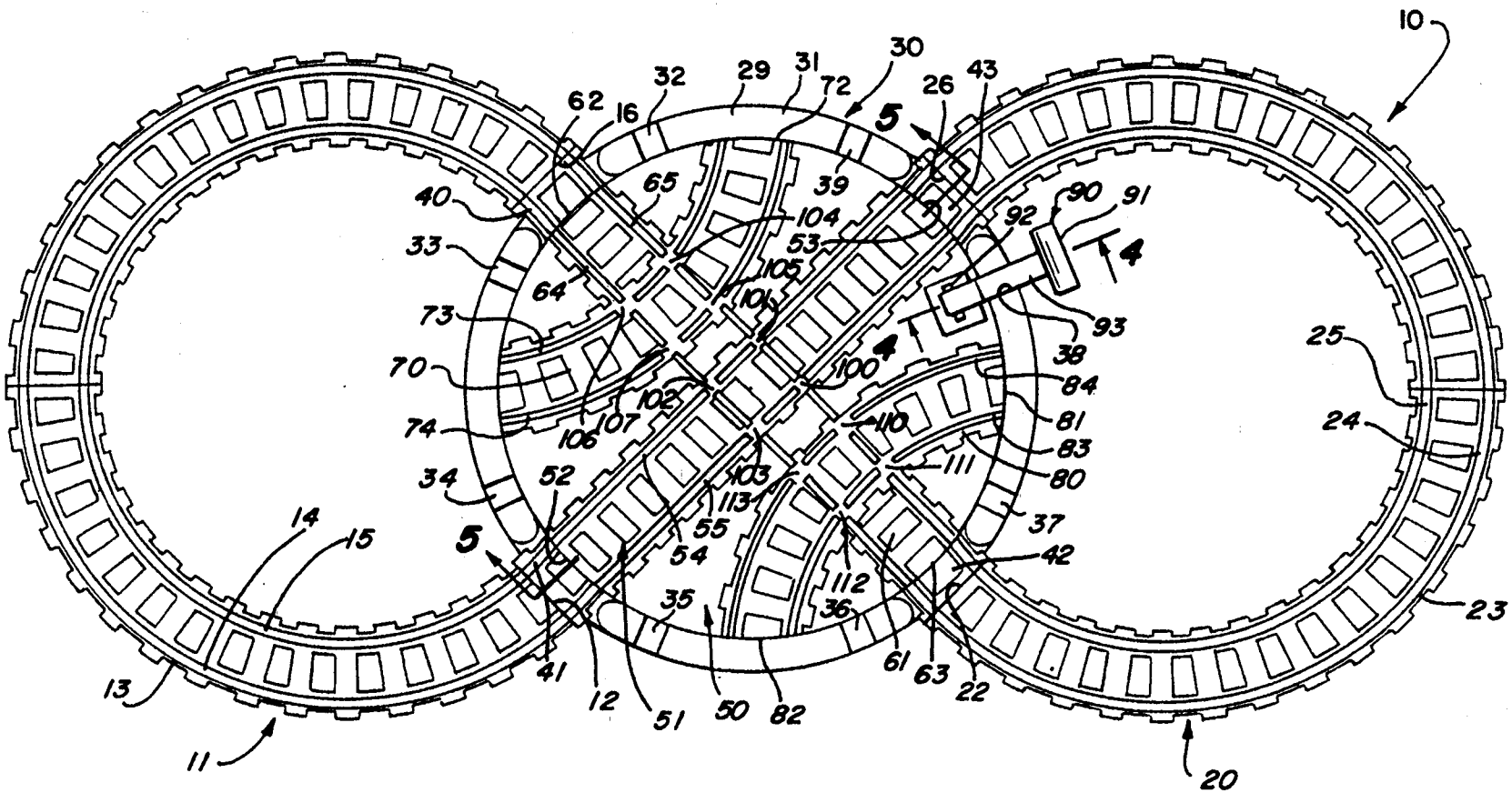
FIG. 1 sets forth a top plan view of a track set with rotating intersection constructed in accordance with the present invention.

FIG. 1 sets forth a top plan view of a track set constructed in accordance with the present invention and generally referenced by numeral 10. In the configuration set forth in FIG. 1, track set 10 defines a figure-eight shaped travel path. By way of comparison, FIG. 2 sets forth a configuration of track set 10 which provides a "peanut"-shaped travel path while FIG. 3 provides a pair of isolated circular loop travel paths. Returning to FIG. 1, track set 10 includes a generally C-shaped loop portion 11 having a circular curved track 13 formed of concentric raised rails 14 and 15. Loop portion 11 defines a pair of end portions 12 and 16.

Track set 10 further includes a virtually mirror image loop portion 20 also defining a generally C-shape and having a pair of concentric spaced apart raised rails 24 and 25 forming a curved track 23. Loop portion 20 defines end portions 22 and 26.

Track set 10 includes a rotating track intersection 30 having a generally circular base 31 having a raised annular rim 29 which in turn defines a plurality of equally spaced notches 32 through 39 extending therethrough. Rim 29 further supports a quartet of track couplers 40, 41, 42 and 43 equally spaced about rim 29 at ninety degree angular positions. Coupler 40 meets end 16 of loop portion 11 while coupler 41 meets end 12 of loop portion 11. Similarly, coupler 42 meets end 22 of loop portion 20 while coupler 43 meets end 26 of loop portion 20. Ends 12 and 16 of loop portion 11 and ends 22 and 26 of loop portion 20 are secured to couplers 40 through 43 respectively by conventional attachment means (not shown).

Track intersection 30 further includes a circular platform 50 rotatably supported within rim 29. The rotational support of platform 50 is set forth below in FIG. 5 in greater detail. However, suffice it to note here that platform 50 is rotatable with respect to base 31 and loop portions 11 and 20 of track 10. Platform 50 defines a pair of orthogonally intersecting straight track segments 51 and 61 each passing through the center of platform 50. Straight track segment 51 defines opposed end portions 52 and 53 and a pair of parallel raised rails 54 and 55. Similarly, straight track segment 61 defines end portions 62 and 63 and a pair of raised parallel rails 64 and 65. Rails 54 and 55 of straight track segment 51 and rails 64 and 65 of straight track segment 61 define interruptions or gaps 100, 101, 102 and 103 therein at the respective intersection of rails 54, 55, 64 and 65 at the center of platform 50. This facilitates the passage of a toy train riding upon either straight segment across the intersecting straight segment.

Platform 50 further supports a curved track segment 70 having end portions 71 and 72 and a pair of concentric raised rails 73 and 74. Rails 73 and 74 of curved segment 70 intersect rails 64 and 65 of straight track segment 61. Rails 73 and 74 and rails 64 and 65 define a plurality of interruptions or gaps 104, 105, 106 and 107 at their intersecting points to facilitate the passage of a toy train vehicle through the intersection of curved segment 70 and straight segment 61 in either direction.

Platform 50 further includes a curved segment 80 having end portions 81 and 82 and a pair of concentric raised rails 83 and 84. Rails 83 and 84 of curved segment 80 and rails 64 and 65 of straight segment 61 define a plurality of interruptions or gaps therein 110, 111, 112 and 113 at the intersections of rails 83 and 84 and rails 64 and 65 to facilitate the travel of a toy train vehicle upon either track segment through the track segment intersection.

Rotating intersection 30 further includes a pivot lock 90 having an elongated lock arm 93 pivotally secured to platform 50 at a pivot 92 at its interior end and extending outwardly from platform 50 and terminating in a handle 91. The structure of platform lock 90 is set forth below in FIG. 4 in greater detail. However, suffice it to note here that platform lock 90 may be raised to a release position which facilitates or permits the rotation of platform 50 upon base 31 or, alternatively, may be lowered to a locking position within a selected one of notches 32 through 39 formed in rim 29 to secure or lock platform 50 at a selected rotational position. In the position shown in FIG. 1, platform 50 is rotatably positioned to align straight track segments 51 and 61 with loop portions 11 and 20 to form a figure-eight travel path. To secure platform 50 in this position, lock arm 93 is received within notch 38 of rim 29. As a result, the rotational position of platform 50 is secured. To configure track set 10 in an alternative position such as the peanut-shape travel path shown in FIG. 2, the user simply raises handle 91 and lock arm 93 to remove lock arm 93 from notch 38 and thereafter rotates platform 50 in the clockwise direction until ends 71 and 72 of curved segment 70 are aligned with ends 62 and 26 of loop portions 11 and 12 respectively. This rotation also aligns platform lock 90 with notch 37 formed in rim 29. Once the rotation of platform 50 is complete, the user simply lowers handle 91 and lock arm 93 to insert lock arm 93 into notch 37 and secure platform 50 in the configuration of FIG. 2. Similarly, the dual circle or dual loop configuration of FIG. 3 is obtained by lifting handle 91 and lock arm 93 and rotating platform 50 until platform lock 90 is aligned with notch 35 in rim 29.

It will also be noted by those skilled in the art that the symmetry of loop portions 11 and 20 and track segments 51, 61, 70 and 80 upon platform 50 provides a redundant trio of track configurations at the remaining three rotational positions of platform 50. Thus, the figure-eight configuration of FIG. 1 is obtained at three additional rotational positions of platform 50 which align platform lock 90 with notches 36, 34 and 32 respectively. Similarly, the peanut-shape track configuration of FIG. 2 may be obtained by rotating platform 50 to align platform lock with notch 37 as described above and additionally to align platform lock 90 with notch 33. Similarly, the dual loop or dual circle configuration of FIG. 3 is obtained by aligning platform lock 90 with either notch 39 or notch 35 in rim 29.

Thus, in accordance with an important aspect of the present invention, track 10 may be configured in a variety of travel path configurations by simply moving rotatable platform 50 to the desired position and locking platform 50 in place using platform lock 90 and the corresponding notch within rim 29. It will be apparent to those skilled in the art that loop portions 11 and 12 of the present invention track set may be configured in alternative shape without departing from the spirit and scope of the present invention and while nonetheless providing their cooperative interaction with rotating track intersection 30. The present invention track set is easily operated by young children and provides excellent spatial relationship training for young children in observing the different track pathway configurations which are obtained by rotating platform 50 through its angular positions. In addition, the redundant positioning of the rotating platform of the present invention track set facilitates additional variations in which the track segments have a directional characteristic rather than the bidirectional characteristic shown in FIGS. 1 through 3. It should be further noted that while the preferred embodiment of the present invention track set set forth herein is that forming a track set for use by toy trains and the like, the invention may be utilized equally well in other types of track toys such as toy vehicle roadways or raceways in which the raised rail carrying portions for the toy train used in the embodiment shown are replaced by other roadway or raceway structures such as recessed track segments, slot cars, or the like.

Figure 2:
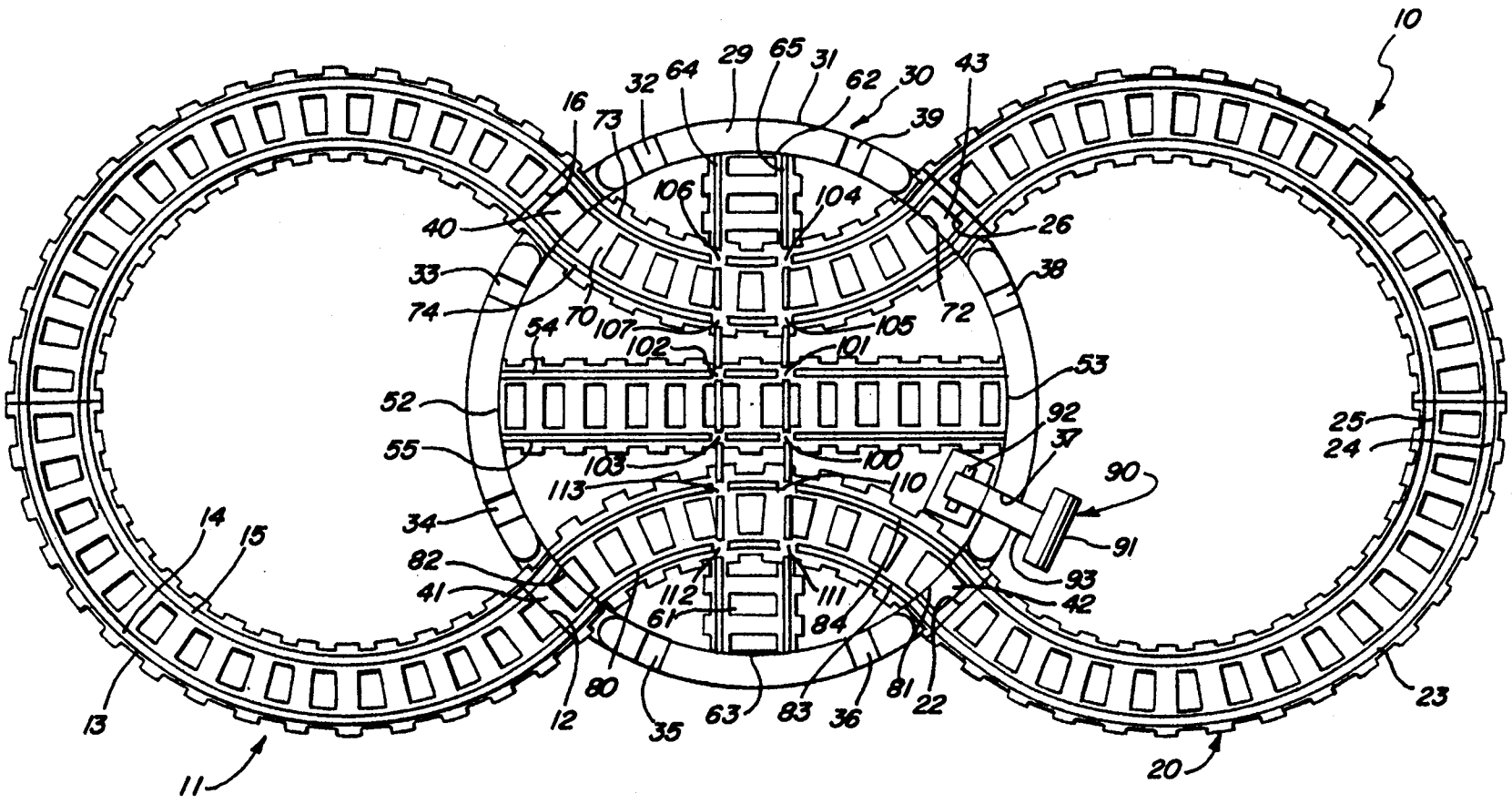
FIG. 2 sets forth a top plan view of the present invention track set having the rotating intersection alternatively positioned.
Figure 3:
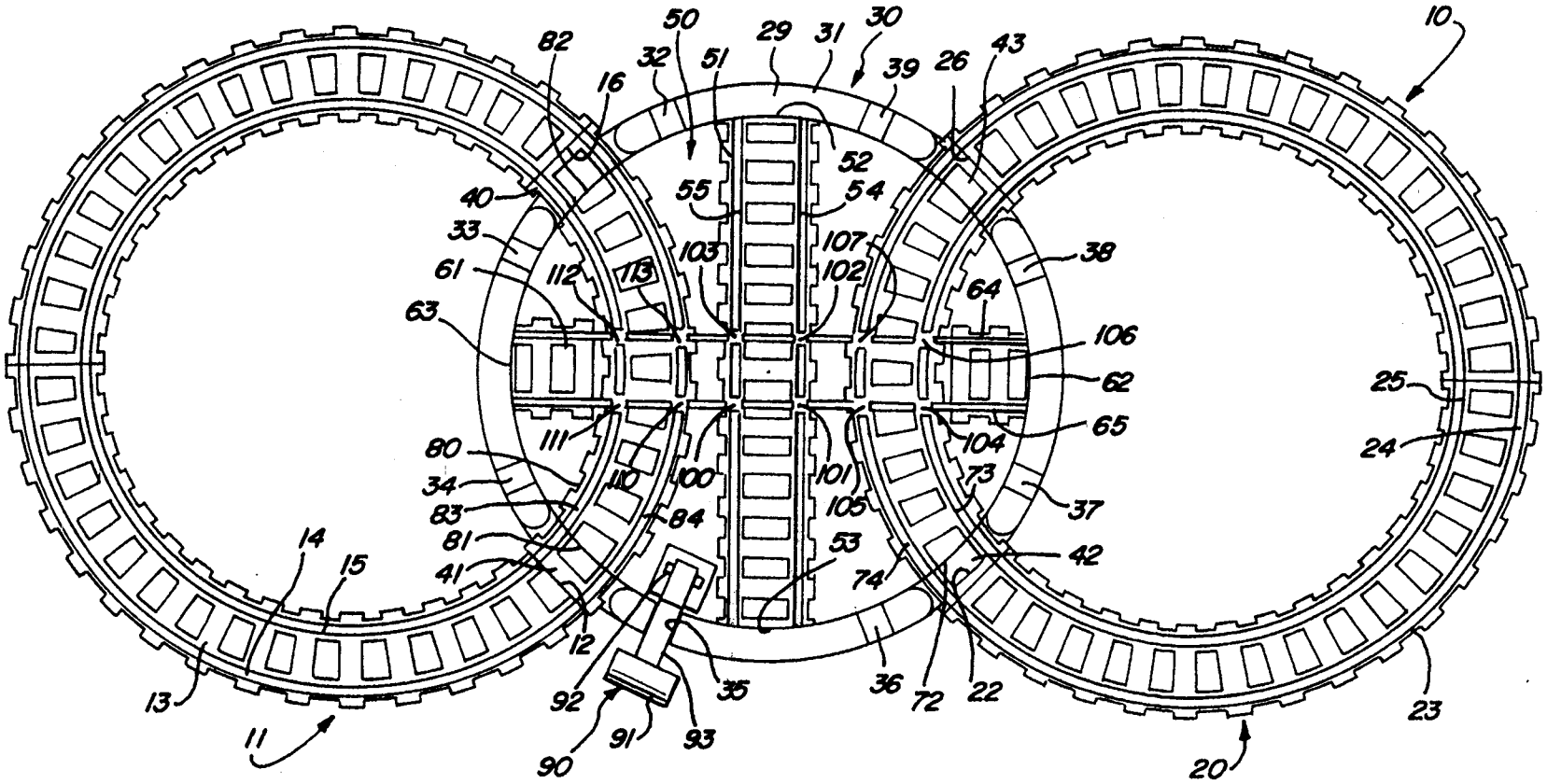
FIG. 3 sets forth a top plan view of the present invention track set having the rotating intersection positioned in a still further alternate position.

FIG. 2 sets forth the present invention track set configured in a peanut-shape travel pathway. As described above, track set 10 includes a pair of loop portions 11 and 20 having end portions 12 and 16 and end portions 22 and 26 respectively. Loop portion 12 includes concentric raised rails 14 and 15 while loop portion 20 includes concentric raised rails 24 and 25. Track intersection 30 includes a circular base 31 defining a raised annular rim 29 having notches 32 through 39 equally spaced therein. Rim 29 further defines track couplers 40 through 43 equally spaced about rim 29. Intersection 30 includes a rotatably supported platform 50 having orthogonally intersecting straight track segments 51 and 61 and curved track segments 70 and 80. Track segment 50 defines end portions 52 and 53 and includes a pair of raised parallel rails 54 and 55. Similarly, track segment 61 includes end portions 62 and 63 and a pair of raised parallel rails 64 and 65. Curved segment 70 includes end portions 71 and 72 and concentric raised rails 73 and 74. Similarly, curved segment 80 includes end portions 81 and 82 and raised concentric rails 83 and 84. Platform 50 further supports a platform lock 90 having a lock arm 93 pivotally secured to platform 50 at a pivot 92 and a handle 91 at its outer end.

In the position shown in FIG. 2, platform 50 is rotated to align platform lock 90 with notch 37 of rim 29 and is received therein to secure the position of platform 50. This rotational position of platform 50 aligns ends 81 and 82 of curved segment 80 with couplers 42 and 41 respectively. Concurrently, ends 71 and 72 of curved segment 70 are aligned with couplers 40 and 43 respectively to provide the peanut-shaped travel path shown in FIG. 2. Thus, a toy train traveling upon track 10 traverses a travel path around loop portion 20 through curved segment 70 and thereafter around loop portion 11 and curved segment 80 to return to loop portion 20 in a closed travel path. As mentioned above, the symmetry of the track segments provides a reciprocal or mirror image position of platform 50 which also produces the travel path configuration of FIG. 2 in which curved segment 70 extends between couplers 41 and 42 while curved segment 80 extends between coupler 40 and 43. In this case, platform lock 90 is received within notch 34 of rim 29.

FIG. 3 sets forth the present invention track set configured in a dual closed loop travel pathway. As described above, track set 10 includes a pair of loop portions 11 and 20 having end portions 12 and 16 and end portions 22 and 26 respectively. Loop portion 12 includes concentric raised rails 14 and 15 while loop portion 20 includes concentric raised rails 24 and 25. Track intersection 30 includes a circular base 31 defining a raised annular rim 29 having notches 32 through 39 equally spaced therein. Rim 29 further defines track couplers 40 through 43 equally spaced about rim 29. Intersection 30 includes a rotatably supported platform 50 having orthogonally intersecting straight track segments 51 and 61 and curved track segments 70 and 80. Track segment 50 defines end portions 52 and 53 and includes a pair of raised parallel rails 54 and 55. Similarly, track segment 61 includes end portions 62 and 63 and a pair of raised parallel rails 64 and 65. Curved segment 70 includes end portions 71 and 72 and concentric raised rails 73 and 74. Similarly, curved segment 80 includes end portions 81 and 82 and raised concentric rails 83 and 84. Platform 50 further supports a platform lock 90 having a lock arm 93 pivotally secured to platform 50 at a pivot 92 and a handle 91 at its outer end.

In the configuration of FIG. 3, platform 50 is rotated to align curved segment 80 with loop portion 11 and to align curved segment 70 with loop portion 20. More specifically, end portions 81 and 82 of curved segment 80 are aligned with couplers 41 and 40 respectively while end portions 71 and 72 are aligned with couplers 43 and 42 respectively. The resulting travel path in the configuration shown in FIG. 3 provides separate loop travel paths, the first formed by loop portion 11 and curved segment 80 and the second formed by loop portion 20 and curved segment 70. As is mentioned above, the symmetry of the various track segments of track 10 produce a redundant or mirror image configuration to that shown in FIG. 3 in which curved segment 80 extends between couplers 42 and 43 while curved segment 70 extends between couplers 40 and 41. In this position, platform lock 90 is received within notch 39 of rim 29.

In accordance with a further advantage of the present invention, the configuration of track 10 may be switched between configurations during the time that a toy train traveling upon track set 10 is moving upon either loop portion 11 or loop portion 20. Thus, the child user is able to participate in an additional amusing facet of the present invention by changing the travel path and direction of the toy train utilizing the rotation of platform 50 between the various track configurations. The switching of track configurations is maintained in an extremely simple fashion to facilitate use by the child user requiring simply the raising of platform lock handle 91 and rotation of platform 50 followed by the lowering of handle 91. The detent action provided by the cooperation of platform lock 90 and the notches formed within rim 29 of base 31 provide easy location of the platform and secure position interlock to avoid derailing of the toy train traveling upon the track set.

Figure 4:
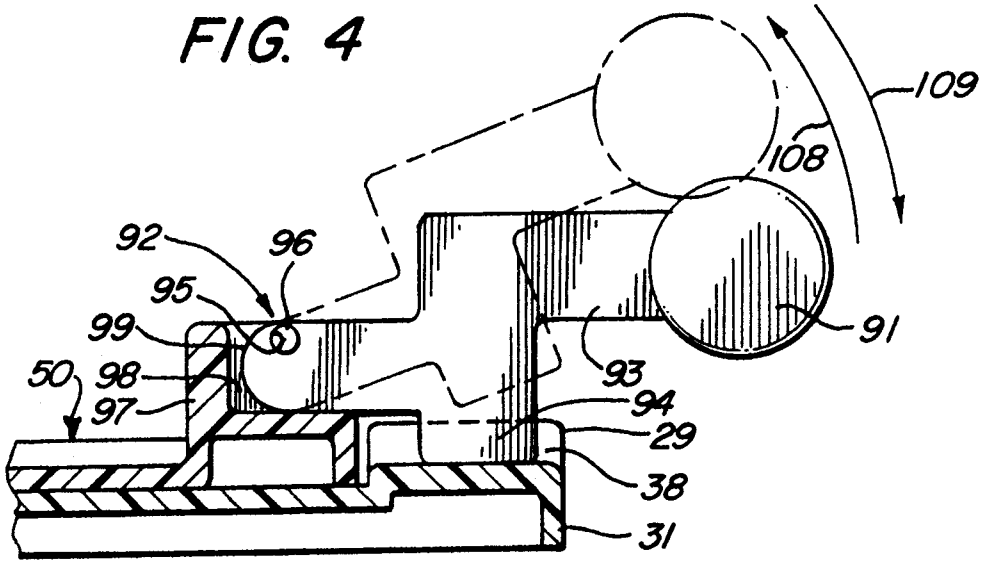
FIG. 4 sets forth a partial section view of the present invention toy track set taken along section lines 4—4 in FIG. 1.

FIG. 4 sets forth a partial section view of track set 10 taken along section lines 4—4 in FIG. 1. As described above, base 31 supports platform 50 and defines an upwardly extending annular rim 29. Rim 29 defines a plurality of notches including a notch 38. Platform 50 defines an upwardly extending post 97 having a channel 98 defined therein. A platform lock 90 includes an elongated lock arm 93 having an end 99 received within channel 98 and defining an aperture 85 therethrough. A cylindrical pin 96 extends through aperture 95 to provide pivotal attachment of end 99 of lock arm 93 to post 97. Lock arm 93 supports a cylindrical handle 91 at its outer end and defines a downwardly extending tab 94 at its approximate center. Tab 94 is generally aligned with rim 29 and thus is receivable within an underlying notch such as notch 38 shown in FIG. 4.

In operation, with handle 91 and lock arm 93 positioned as shown in solid-line representation in FIG. 4, platform 50 is securely locked in position. Platform lock 90 is released by pivoting handle 91 and lock arm 93 upwardly in the direction indicated by arrow 108 to the dashed-line position shown. The upward pivotal motion of handle 91 and lock arm 93 removes tab 94 from the underlying notch of rim 29 and permits platform 50 to be rotated with respect to base 31. When the desired rotational position is reached, handle 91 and lock arm 93 are pivoted downwardly in the direction indicated by arrow 109 to insert tab 94 into the underlying notch of rim 29. The pivotal attachment of lock arm 93 at its interior end permits the use of gravitational force upon lock arm 93 and handle 91 to secure or maintain platform lock 90 in the locked position.

Figure 5:
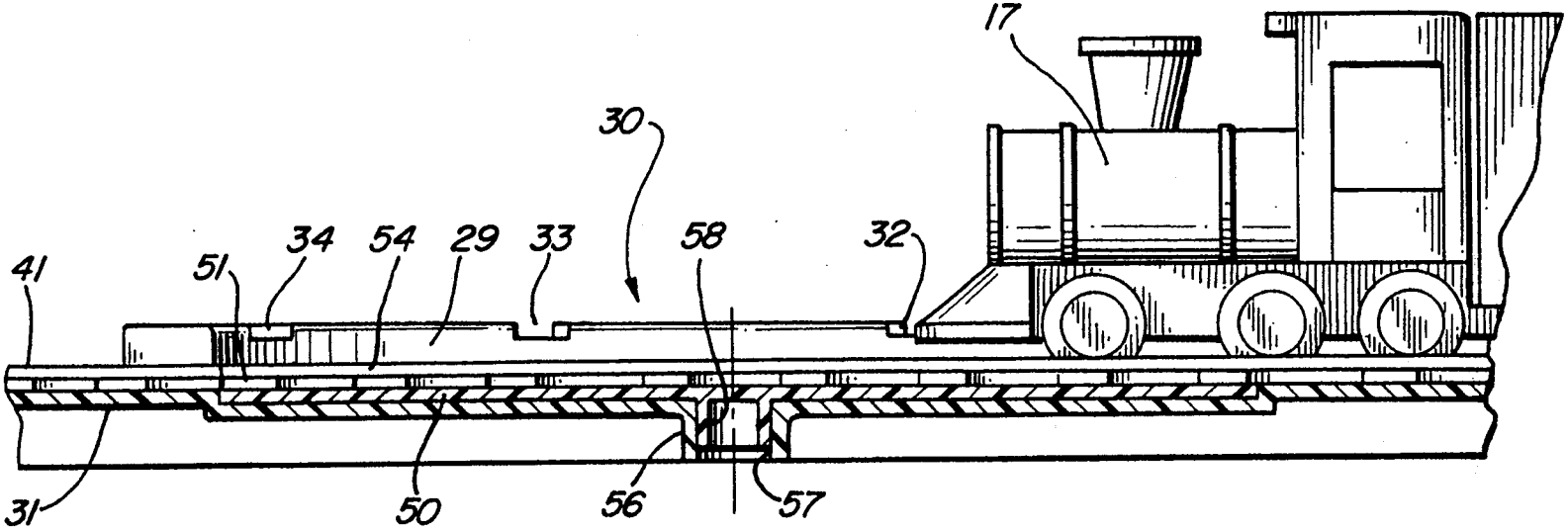
FIG. 5 sets forth a section view of the present invention track set taken along section lines 5—5 in FIG. 1.

FIG. 5 sets forth a section view of track set 10 taken along section lines 5—5 in FIG. 1. As described above, track set 10 includes a base 31 upon which a platform 50 is rotatably supported. Platform 50 supports a track segment 51 having a pair of raised rails 54 and 55 (the latter seen in FIG. 1). Base 31 further includes an upwardly extending annular rim 29 having a plurality of notches such as notches 32, 33 and 34 formed therein. Base 31 further includes a coupler 41 aligned with track segment 51 and supported by base 31. Base 31 includes a center boss 56 having a cylindrical bore 57 formed therein. Boss 56 and bore 57 are generally centered upon base 31 with respect to annular rim 29. Platform 50 is generally circular in shape and supports track segment 51 and includes a downwardly extending center post 58 at its center. Center post 58 is received within bore 57 of boss 56 to provide pivotal attachment of platform 50 to base 31 and facilitate its rotation as described above. An exemplary toy train 17 constructed in accordance with conventional fabrication techniques is shown traveling upon track segment 51 and traversing track intersection 30.

What has been shown is a novel track set having a rotating intersection for toy trains or the like in which a plurality of track configurations are provided by the simple rotational positioning of a platform disposed within the track intersection. In the example shown, a pair of C-shaped track segments are coupled to a circular base within which the rotatable platform is positioned. The rotational position of the platform determines the travel path configuration for the track set and facilitates a figure-eight, a peanut-shape, and a pair of distinct circular loops at different rotational positions of the platform. The locking mechanism of the platform is easily handled by young children and provides a secure positional lock which assures proper positioning of the platform with respect to the loop track portions.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle track set comprising:

a base;

a track intersection having a platform rotatably supported by said base and having a pair of intersecting generally straight track segments and a pair of curved track segments each intersecting and passing through a common one of said straight track segments on opposite sides of the intersection of said straight track segments;

a pair of loop track segments supported on each side of said track intersection each having open ends; and lock means for securing said platform at a plurality of rotational positions, said platform being rotatable to a first position in which said straight track segments couple said loop track segments to form a figure-eight path, a second position in which said pair of curved segments couple said loop track segments to form a peanut-shaped path and a third position in which said pair of curved track segments couple said loop track segments to form two separate closed loop paths.

2. A toy vehicle track set as set forth in claim 1 wherein said pair of intersecting generally straight track segments are generally orthogonal.

3. A toy vehicle track set as set forth in claim 2 wherein said pair of curved track segments are generally arcuate.

4. A toy vehicle track set as set forth in claim 3 wherein said pair of curved track segments are symmetrically positioned with respect to the intersection of said generally straight track segments.

5. A toy vehicle as set forth in claim 4 wherein said pair of loop track segments define mirror-image C-shaped segments each open toward said track intersection.

6. A toy vehicle as set forth in claim 5 wherein said base defines an annular rim encircling said platform and defining a plurality of notches therein and wherein said lock means includes a lock lever pivotally secured to said platform having a portion receivable within a selected one of said notches.

7. A toy vehicle as set forth in claim 1 wherein said base defines an annular rim encircling said platform and defining a plurality of notches therein and wherein said lock means includes a lock lever pivotally secured to said platform having a portion receivable within a selected one of said notches.

8. A toy vehicle track set comprising:

a pair of loop track segments each having open ends;

a rotatable platform interposed between said loop track segments and having first and second track segments intersecting at a first intersection, a third track segment intersecting and passing through said first track segment and a fourth track segment intersecting and passing through said first track segment, said third and fourth track segments intersecting and passing through said first track segment on opposite sides of said first intersection, said platform being rotatable to a first position in which said first and second track segments and said loop track segments form a figure-eight, a second position in which said third and fourth track segments and said pair of loop track segments form a peanut-shape and a third position in which said third and fourth track segments and said pair of loop track segments form a pair of distinct closed paths.

9. A toy vehicle track set as set forth in claim 8 further including means for locking said platform at either said first, second or third position.

10. A toy vehicle track set comprising:

a pair of loop track portions each having a pair of open ends; and a common track switch interposed between said loop track portions, said track switch having means for alternatively forming a figure-eight track path, a peanut-shape track path or a separate pair of closed loop track paths, said common track switch including a rotatable platform having first, second, third and fourth track segments supported thereon and wherein said second track segment intersects said first track segment to form a cross-over intersection and wherein said third and fourth track segments intersect and pass through said first track segment on opposite sides of said cross-over intersection.

11. A toy vehicle track set as set forth in claims wherein said platform is rotatable to a first position in which said first and second track segments and said loop track segments from said figure-eight, a second position in which said third and fourth track segments and said pair of loop track segments form said peanut-shape and a third position in which said third and fourth track segments and said pair of loop track segments form said pair of distinct closed paths.

* * * * *